US011005167B2

(12) United States Patent
Apostolos et al.

(10) Patent No.: US 11,005,167 B2
(45) Date of Patent: May 11, 2021

(54) LOW PROFILE ANTENNA-CONFORMAL ONE DIMENSIONAL

(71) Applicant: Antenum LLC, Merrimack, NH (US)

(72) Inventors: John T. Apostolos, Lyndeborough, NH (US); William Mouyos, Windham, NH (US)

(73) Assignee: Antenum LLC, Merrimack, NH (US)

( * ) Notice: Subject to any disclaimer, the term of this patent is extended or adjusted under 35 U.S.C. 154(b) by 138 days.

(21) Appl. No.: 16/456,281

(22) Filed: Jun. 28, 2019

(65) Prior Publication Data

US 2019/0393589 A1 Dec. 26, 2019

Related U.S. Application Data

(63) Continuation-in-part of application No. 16/179,069, filed on Nov. 2, 2018.

(60) Provisional application No. 62/733,162, filed on Sep. 19, 2018, provisional application No. 62/692,065, filed on Jun. 29, 2018, provisional application No. 62/624,714, filed on Jan. 31, 2018, provisional application No. 62/584,966, filed on Nov. 13, 2017, provisional application No. 62/581,110, filed on Nov. 3, 2017.

(51) Int. Cl.
*H01Q 1/32* (2006.01)
*H01Q 21/28* (2006.01)

(52) U.S. Cl.
CPC ..... *H01Q 1/32* (2013.01); *H01Q 21/28* (2013.01)

(58) Field of Classification Search
CPC ..... H01Q 1/32; H01Q 21/065; H01Q 21/28; H01Q 21/245; H01Q 5/321
See application file for complete search history.

(56) References Cited

U.S. PATENT DOCUMENTS 3,045,237 A * 7/1962 Marston ..... H01Q 3/46 343/754
4,129,874 A 12/1978 Marietta et al.
(Continued)

FOREIGN PATENT DOCUMENTS

DE 102009038150 A1 3/2011

OTHER PUBLICATIONS

International Search Report and Written Opinion dated Feb. 11, 2019 for Related PCT/US18/58911.
(Continued)

*Primary Examiner* — Graham P Smith
*Assistant Examiner* — Jae K Kim
(74) *Attorney, Agent, or Firm* — David J. Thibodeau, Jr.; VLP Law Group LLP

(57) ABSTRACT

An antenna array consists of multiple sub-arrays of planar, rectangular conductive patches disposed over a cavity to provide a volumetric antenna array. Each sub-array consist of multiple patch elements, arranged typically in a square or rectangular pattern. Multiple sub-arrays are further arranged along a one-dimensional row, to provide one or more unit cells. Adjacent sub-arrays in a row may be oriented at 45 degrees with respect to one another. The assembly provides a wide bandwidth, orientation dependent, directional antenna via volumetric radiating elements that can be conformal to exterior surface(s) of a vehicle such as a roof or trunk or roll bar of a passenger car.

1 Claim, 3 Drawing Sheets

(56) References Cited

U.S. PATENT DOCUMENTS 5,801,521 A * 9/1998 Mizoguchi ..... H01F 17/0006 323/282
6,011,524 A * 1/2000 Jervis ..... H01Q 1/42 343/859
6,431,712 B1 8/2002 Turnball
7,785,098 B1 * 8/2010 Appleby ..... G21K 1/02 425/470
8,666,090 B1 3/2014 Townsend
8,842,040 B1 * 9/2014 Dorsey ..... H01Q 21/24 342/174
8,884,834 B1 * 11/2014 Paschen ..... H01Q 9/28 343/805
2004/0119644 A1 6/2004 Puente-Baliarda et al.
2006/0055613 A1 3/2006 Angelucci
2006/0152406 A1 * 7/2006 Leblanc ..... G01S 7/032 342/175
2007/0236404 A1 10/2007 Snider et al.
2008/0211726 A1 * 9/2008 Elsallal ..... H01Q 13/08 343/770
2009/0096691 A1 * 4/2009 Apostolos ..... H01Q 11/12 343/742
2010/0013318 A1 * 1/2010 Iguchi ..... H05K 1/0234 307/91
2010/0103049 A1 * 4/2010 Tabakovic ..... H01Q 9/0457 343/700 MS
2010/0123619 A1 5/2010 Shijo et al.
2010/0188301 A1 * 7/2010 Kishimoto ..... F21V 5/04 343/721
2011/0095385 A1 * 4/2011 Kawamura ..... H01Q 1/38 257/428
2012/0280380 A1 * 11/2012 Kamgaing ..... H01Q 1/2283 257/679
2013/0027267 A1 * 1/2013 Homan ..... A61B 5/07 343/810
2013/0187726 A1 * 7/2013 Apostolos ..... H01Q 5/321 333/17.3
2014/0015728 A1 * 1/2014 Anguera Pros ..... H01Q 9/0414 343/843
2014/0118210 A1 * 5/2014 Cooper ..... H01Q 9/28 343/795
2014/0311242 A1 * 10/2014 Lee ..... G01C 19/56 73/504.12
2015/0078527 A1 * 3/2015 Iwamoto ..... A61B 6/4405 378/91
2015/0084814 A1 * 3/2015 Rojanski ..... H01Q 1/42 342/368
2015/0171522 A1 * 6/2015 Liu ..... H01Q 5/42 343/796
2015/0214624 A1 * 7/2015 Kwon ..... H01Q 9/0421 455/562.1
2015/0214634 A1 * 7/2015 Lee ..... H01Q 9/065 343/797
2015/0234035 A1 * 8/2015 Lohoefener ..... G01S 13/953 343/702
2015/0323456 A1 * 11/2015 Agashe ..... G01N 21/01 356/445
2015/0357700 A1 12/2015 Kagaya et al.
2015/0364813 A1 12/2015 Darnell et al.
2016/0286619 A1 * 9/2016 Roberts ..... H05B 47/105
2016/0322708 A1 * 11/2016 Tayfeh Aligodarz ..... H01Q 9/0485
2016/0363686 A1 * 12/2016 Kouchmeshky ..... H01Q 1/04
2017/0317397 A1 11/2017 Faraone et al.
2018/0190600 A1 * 7/2018 Kook ..... H01L 23/04
2018/0275343 A1 * 9/2018 Zheng ..... G02B 6/1226
2018/0342810 A1 * 11/2018 Yu ..... H01Q 19/09
2020/0076078 A1 * 3/2020 Tehran ..... H01Q 1/523

OTHER PUBLICATIONS

International Search Report and Written Opinion dated Oct. 9, 2019 for Related PCT/US19/39705.

* cited by examiner

LOW PROFILE ANTENNA-CONFORMAL ONE DIMENSIONAL

CROSS REFERENCE TO RELATED APPLICATIONS

This patent application claims priority to a co-pending U.S. Provisional application entitled "Low Profile Antenna—Conformal One Dimensional", Ser. No. 62/692,065 filed Jun. 29, 2018, and claims priority to a co-pending U.S. Application entitled "SMART ANTENNA FOR IN-VEHICLE APPLICATIONS THAT CAN BE INTEGRATED WITH TCU AND OTHER ELECTRONICS", Ser. No. 16/179,069 filed Nov. 2, 2018. This application also relates to a co-pending U.S. patent application entitled "Low Profile Antenna—Conformal", Ser. No. 15/861,749 filed Jan. 4, 2018 and relates to a co-pending U.S. Application entitled "SMART ANTENNA FOR IN-VEHICLE APPLICATIONS THAT CAN BE INTEGRATED WITH TCU AND OTHER ELECTRONICS", Ser. No. 16/179,069 filed Nov. 2, 2018. The entire contents of each of the above applications are hereby incorporated by reference.

BACKGROUND

Technical Field

This patent application relates to antennas and more particularly to a low-profile, conformal antenna array suitable for operating across a wide range of frequencies including AM/FM, 3G/4G, cellular, Wi-Fi, Bluetooth, GPS, satellite radio, and even proposed 5G wireless and vehicle-to-vehicle bands.

SUMMARY

Miniaturized antennas can be provided using arrays of planar, volumetric conductors. By arranging these components in an appropriate configuration, the electrical properties of the antenna can be passively and/or automatically optimized over a wide bandwidth. This approach is particularly useful in vehicle applications since no part of the antenna needs to protrude beyond the skin of the vehicle.

An antenna array constructed in accordance with the teachings herein consists of multiple sub-arrays of planar, rectangular conductive patches disposed over a cavity to provide a volumetric antenna array. Each sub-array may consist of four patch elements, arranged typically in a square or rectangular pattern. Multiple sub-arrays may be further arranged along a one-dimensional row (or along a line), to provide one or more unit cells. Adjacent sub-arrays in a row may be oriented at 45 degrees with respect to one another.

The resulting structure may respond to Right-Hand Circularly Polarized (RHCP) and/or Left Hand Circularly Polarized (LHCP) energy with separate ports for each polarization. Diversity may be provided by generating orthogonal sine and cosine beams which may be created by subtracting diagonally juxtaposed elements. Operating modes may provide four orthogonal, simultaneous, unidirectional beams 0, 90, 180, and 270 degrees at the RHCP and LHCP ports.

The low-profile structure may be located in close proximity to or conformal with the sheet metal of a vehicle roof, or trunk, or roll bar and/or integrated within a non-metallic radome.

BRIEF DESCRIPTION OF THE DRAWINGS

The description below refers to the accompanying drawings, of which.

DETAILED DESCRIPTION OF AN EMBODIMENT

Figure 1:
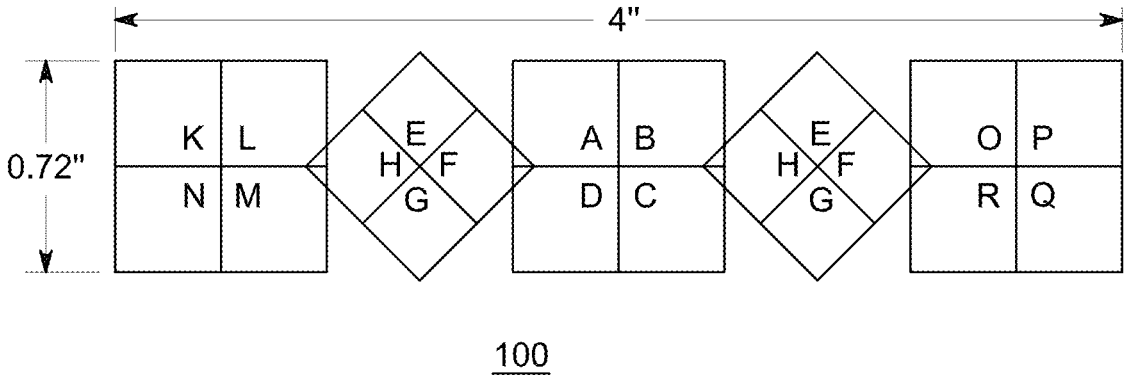
FIG. 1 shows a unit cell consisting of five sub-arrays.

FIG. 1 is a schematic view of an embodiment of a unit cell 100 component of a Low Profile, Conformal antenna (referred to as a LOPAC or CALPRO antenna structure herein). The unit cell consists of a set of five sub-arrays disposed over one or more cavities, with FIG. 3 being one example of the unit cell 100 disposed over a cavity 300. Each sub-array consists of four voumetric elements, such as planar conductive surfaces or patches located over the cavity.

The individual radiating patches are typically arranged in groups of four to provide for orientation independent volumetric, superdirective antennas. This type of antenna is described in our previous patents such as U.S. Pat. No. 9,147,936 entitled "Low-Profile, Very Wide Bandwidth Aircraft Communications Antennas Using Advanced Ground-Plane Techniques," as well as U.S. patent application Ser. No. 15/362,988 filed Nov. 29, 2016 entitled "Super Directive Array of Volumetric Antenna Elements for Wireless Device Applications," and U.S. patent application Ser. No. 15/861,749 filed Jan. 4, 2018 entitled "Low Profile Antenna—Conformal", and U.S. Provisional Patent Application No. 62/584,966 filed Nov. 13, 2017 entitled "Improved Low Profile Antenna—Conformal" the entire contents of all of which are hereby incorporated by reference.

The structure 100 shown is thus similar to that described in the above-referenced patents and co-pending patent applications, but with some differences. For example, a given sub-array, such as the left-most one shown, has a neighboring sub-array that is diagonally rotated. That is, each sub-array is rotated at a 45 degree angle with respect to its immediate neighboring sub-array. Although not shown in this figure, as with the embodiments described in the other pending patent applications, a number of frequency selective coupling elements such as meanderlines may connect the patches in each sub-array to one another and/or to the surrounding conductive surfaces, which may be the surfaces of a vehicle. These selective couplings are for tuning the structure across many different frequency bands.

In some arrangements, selected radiators may slightly physically overlap with radiators in their immediate neighboring sub-array.

The antenna array can be configured for operating across a wide range of frequencies including AM/FM, 3G/4G, cellular, Wi-Fi, Bluetooth, GPS, satellite radio, and even proposed 5G wireless and vehicle-to-vehicle bands. For example, selectively activating sets of the radiating patches in each unit cell may enable operation in these different frequency bands. Note the letters labelling each radiating element in the sub-arrays. For a unit cell sized as shown (a width of approximately 4 inches and height of 0.72 inches) actively coupling elements A, B, C, D to a radio transceiver provides operation in the 600-3800 MHz band, actively coupling elements E, F, G, H to a transceiver provides operation from 3800-6000 MHz, and actively coupling elements O, P, Q, R and K, L, M, N to a transceiver provides operation in the 1500-3800 MHz band.

Figure 2:
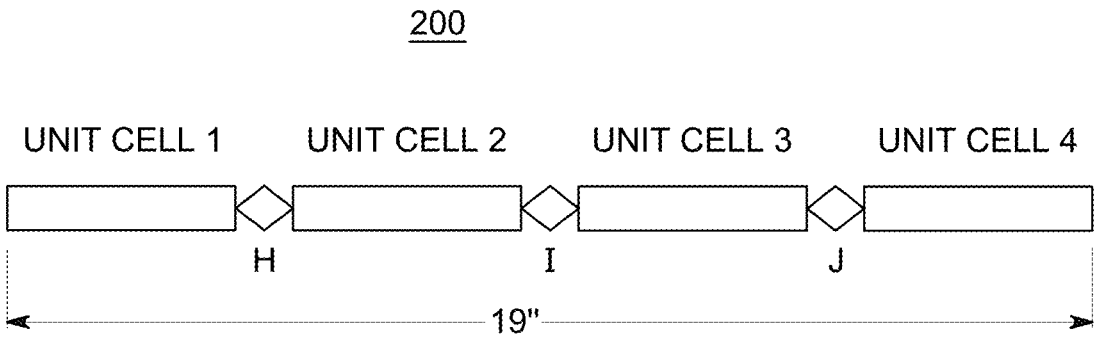
FIG. 2 is another arrangement consisting of multiple unit cells.

FIG. 2 shows a structure 200 where multiple unit cells 100 are combined to provide additional operating modes. This example structure 200 combines four unit cells 100 to provide a linear array of radiators in each of several operating bands. For example, all of the A, B, C, D radiators in all four unit cells are activated when operating in the 600-3800 MHz band. Elements E, F, G, H in all four unit cells provides operation from 3800-6000 MHz, and coupling all elements O, P, Q, R and K, L, M, N in all four unit cells provides operation in the 1500-3800 MHz band.

Sub-arrays (labelled H, I, J) rotated at 45 degrees are disposed between adjacent unit cells. The sub-arrays H, I, and J are coupled to transceivers to operate in the GPS, GNSS, or SDARS bands.

Individual sub-arrays can be further connected to operate with linear or horizontal polarizations. Circular polarization can be provided in an end-fire configuration.

Possible operating modes include

- 4×4 Multiple Input Multiple Output (MIMO) using 4 unit cells (e.g., FIG. 2) with linear polarization
- 8×8 MIMO using four unit cells (e.g., FIG. 2) with circular polarization
- 2×2 MIMO using a unit cell with an orthogonal "figure of 8" shaped elements
- Unit cell with a linear phased array (using circular or linear polarization end-fire to broadside)

Figure 3:
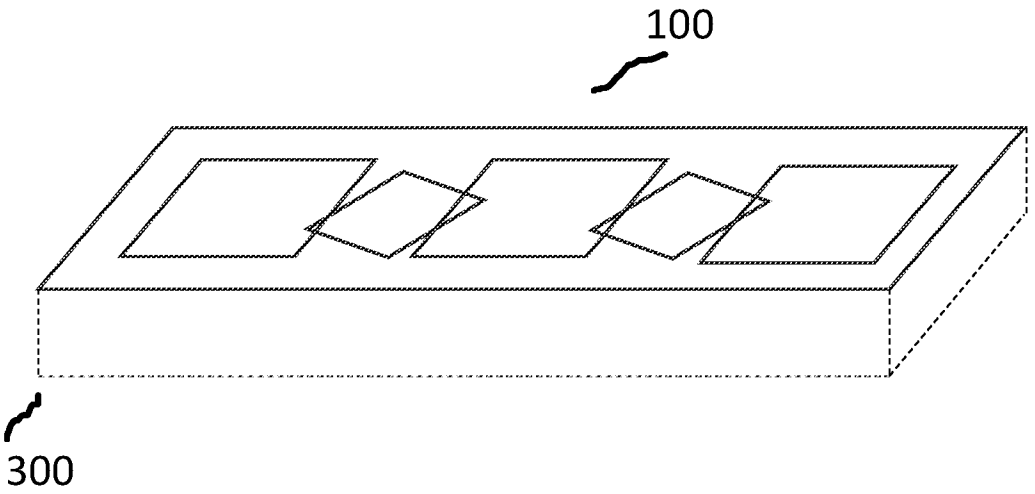
FIG. 3 shows the structure of FIG. 1 arranged over a ground plane and conformal to a vehicle surface.

FIG. 3 shows the low-profile structures 100, 200 may be located over a cavity 300. The cavity may be formed within or or conformal to the sheet metal of a vehicle roof, or trunk, or roll bar and/or integrated within a non-metallic radome.

We have described a single assembly that is conformal antenna having a low profile that consists of nested orientation-independent sub-arrays. The structure can respond to right-hand circulay polarized and left-hand circulay polarized beams simultaneously, providing separate I/O ports for each polarization. Diversity can be provided with simultaneous bidirectional orthogonal sine and cosine beams created by subtracting the diagonally opposite radiators.

While various apparatus and methods have been particularly shown and described with references to example embodiments thereof, it will be understood by those skilled in the art that various changes in form and details may be made therein without departing from the scope of the invention(s) encompassed by the appended claims.

What is claimed is:

1. An antenna for use in a vehicle comprising:

a cavity having conductive walls;

a plurality of radiating surfaces disposed in a reference plane located above the cavity, such that each radiating surface comprises a quadrilateral surface having four sides, with a group of four quadrilateral surfaces comprising an orientation independent sub-array, and such that a plurality of sub-arrays are disposed in groups to thereby provide a unit cell, with adjacent sub-arrays rotated at 45 degrees with respect to one another, and a plurality of frequency dependent couplings, each frequency dependent coupling disposed between a respective one of the radiating surfaces of the selected orientation-independent radiator and the other orientation-independent radiator and/or a ground plane element.

* * * * *